US006499538B2

(12) United States Patent
Dewey et al.

(10) Patent No.: US 6,499,538 B2
(45) **Date of Patent: *Dec. 31, 2002**

(54) METHOD AND APPARATUS FOR FORMING AN OPTIMIZED WINDOW

(75) Inventors: Charles H. Dewey, Houston, TX (US); John E. Campbell, Houston, TX (US)

(73) Assignee: Smith International, Inc., Houston, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/288,401

(22) Filed: Apr. 8, 1999

(65) Prior Publication Data

US 2001/0054506 A1 Dec. 27, 2001

(51) Int. Cl.[7] ..... E21B 29/06
(52) U.S. Cl. ..... 166/297; 166/117.5; 166/55.3
(58) Field of Search ..... 166/117.5, 55.3, 166/297, 298, 50

(56) References Cited

U.S. PATENT DOCUMENTS

| | | | | | |
|---|---|---|---|---|---|
| 2,882,015 A | | 4/1959 | Beck | 255/1.6 |
| 5,113,938 A | * | 5/1992 | Clayton | 166/117.6 |
| 5,467,820 A | | 11/1995 | Sieber | 166/117.6 |
| 5,522,461 A | * | 6/1996 | Carter et al. | 166/298 |
| 5,676,206 A | * | 10/1997 | Rehbock et al. | 166/117.5 |
| 5,771,972 A | * | 6/1998 | Dewey et al. | 166/298 |
| 5,816,324 A | | 10/1998 | Swearingen et al. | 166/117.5 |
| RE36,526 E | * | 1/2000 | Braddick | 166/297 |
| 6,012,516 A | * | 1/2000 | Brunet | 166/50 |

FOREIGN PATENT DOCUMENTS

| | | |
|---|---|---|
| GB | 2310231 A | 3/1997 |
| GB | 2312702 A | 11/1997 |
| GB | 2313391 A | 11/1997 |
| WO | WO97/27380 | 7/1997 |

OTHER PUBLICATIONS

British Search Report for Application No. GB 0007672.9 dated Aug. 9, 2000; (2 p.).

* cited by examiner

*Primary Examiner*—William Neuder
*Assistant Examiner*—Zakiya Walker
(74) *Attorney, Agent, or Firm*—Conley, Rose & Tayon, P.C.

(57) ABSTRACT

Methods and apparatus are described for forming a window of optimum dimensions in casing wall. A window of maximum width is cut when the center line of the mill tool is located inside of the inner diameter of the casing where a maximum amount of casing is drilled away by the mill tool. A whipstock is described which deviates the mill tool outwardly so that the center line of the mill tool is in approximately this position. The whipstock then maintains the mill tool at this approximate location until a window of desired length is cut having a substantially maximum width.

42 Claims, 8 Drawing Sheets

METHOD AND APPARATUS FOR FORMING AN OPTIMIZED WINDOW

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention relates to methods and apparatus for cutting or milling a window in a cased borehole so that a secondary or deviated borehole can be drilled. More particularly, the invention relates to methods and apparatus for forming a window of optimal dimensions.

2. Description of the Related Art

It is common practice to use a whipstock and mill arrangement to help drill a deviated borehole from an existing earth borehole. The whipstock is set on the bottom of the existing earth borehole or anchored within the borehole. The whipstock has a ramped surface that is set in a predetermined position to guide a mill in a deviated manner so as to mill away a portion of the wellbore casing, thus forming a window in the steel casing of the borehole.

The typical whipstock presents a ramped surface which has a substantially uniform slope such as three degrees from the vertical. Thus, the mill tool is normally urged outwardly at a constant rate until it is fully outside of the casing. As the mill moves downward within the borehole, the ramped surface of the whipstock urges the mill radially outwardly so that the cutting surface of the mill engages the inner surface of the casing. As this engagement begins to cut into the casing, the casing is worn away and then cut through, thus beginning the upper end of the window. The ramp of the whipstock then causes further deviation of the mill, causing the mill to move downwardly and radially outward through the casing itself. Thus, a longitudinal window is cut through the casing. Ultimately, the whipstock's ramped surface urges the mill radially outwardly to the extent that it is located entirely outside of the wellbore bore casing. Once this occurs, the mill ceases cutting the window. This traditional cutting technique results in an upside-down "teardrop" shaped window which has a section of maximum width located close to the top of the window. From this section of maximum width, the width of the window decreases and the window tapers as the lower portion of the window is approached. An example of such a window is shown in prior art FIG. 1.

Once the window is cut in the manner described above, a deviated borehole is then cut using a point of entry that is proximate the teardrop-shaped window. Unfortunately, the teardrop shape of the window can impede the ability to drill the deviated borehole. Specifically, as the window narrows, the metal portion of the casing interferes with the ability to drill, place liners and so forth.

Thus, a need exists for methods and devices that can be employed to form a window in a easing wall that has optimum or near optimum dimensions so that subsequent directional drilling efforts are not hindered.

BRIEF SUMMARY OF THE INVENTION

The invention provides methods and apparatus for forming a window of optimum dimensions in casing wall. The inventor has recognized that a window of maximum width is cut when the center line of the mill tool is located a distance inside of the inner diameter of the casing where a maximum amount of casing is drilled away by the mill tool. A whipstock is described which deviates the mill tool outwardly so that the center line of the mill tool is in approximately this position. The whipstock then maintains the mill tool at this approximate location until a window of desired length is cut having a substantially maximum width. Other objects and advantages of the present invention will appear from the following description.

BRIEF DESCRIPTION OF THE DRAWINGS

For a detailed description of the preferred embodiment of the invention, reference will be made to the accompanying drawings wherein.

DETAILED DESCRIPTION OF THE PREFERRED EMBODIMENTS

Figure 1:
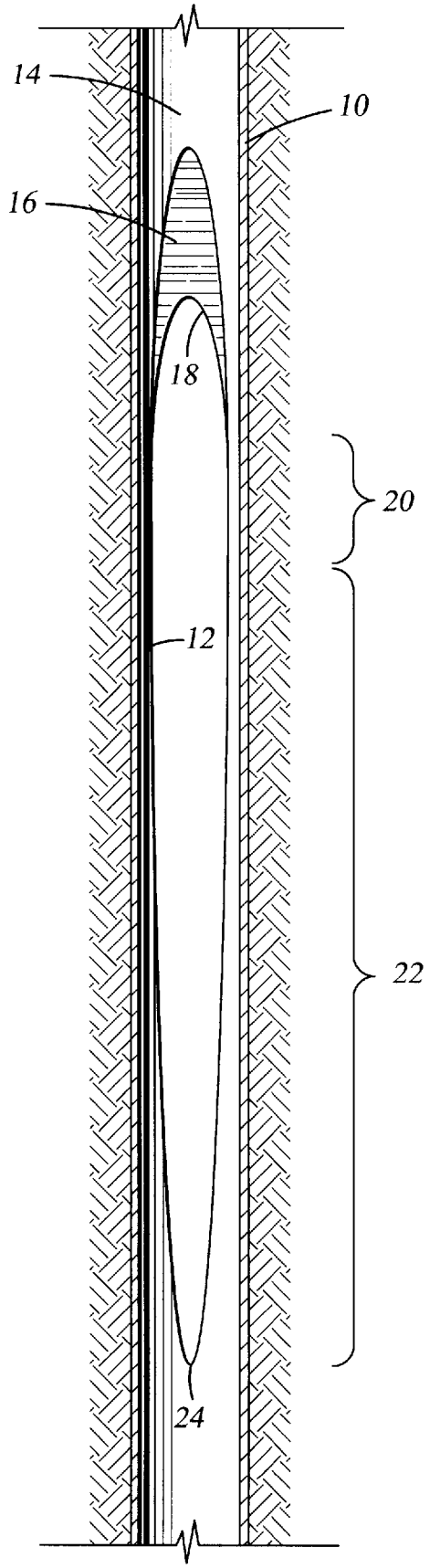
Fig. 1 (PRIOR ART)
FIG. 1 is a cross-sectional view of a borehole depicting a typical "teardrop shaped" window of the type cut by conventional whipstock and mill arrangement.

Referring first to prior art shown in FIG. 1, a standard wellbore casing 10 is depicted having a milled window 12. As is apparent, the inner surface 14 of the casing 10 is shown. At the upper portion of the window 12 is milled away portion 16 which has resulted from initial engagement of a mill tool with the inner surface 16. The upper end 18 of the window 12 tapers outwardly to a maximum width. It should be understood that the term "width" refers to the lateral distance between the two edges of the window. Conversely, the term "length" refers to the distance from the top edge to the bottom edge of the window. The window provides a section 20 of substantially maximum width. It can be appreciated that the section of maximum width occurs near the top edge 18 of the window 12. The lower section of the window 12 presents a tapered portion 22 which narrows in width until the lower edge 24 is reached.

Figure 2A:
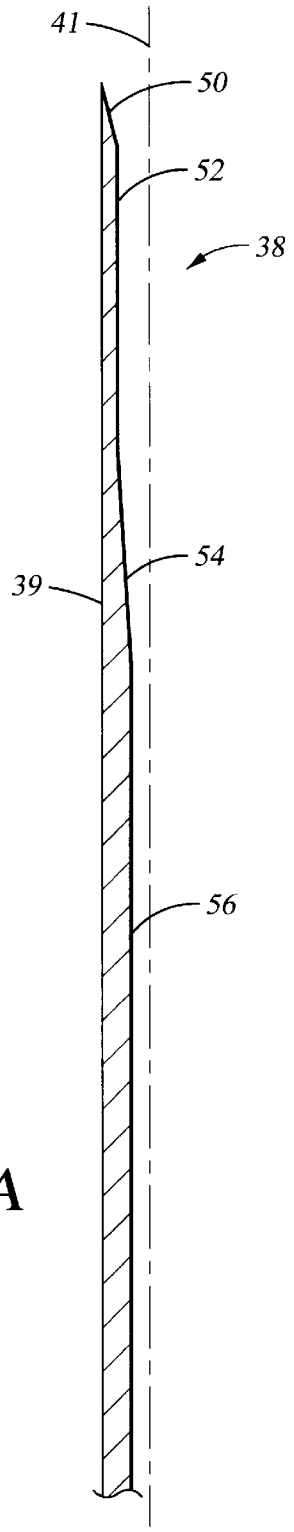
FIGS. 2A and 2B are cross-sectional illustrations of an exemplary whipstock constructed in accordance with the present invention.
Figure 2B:
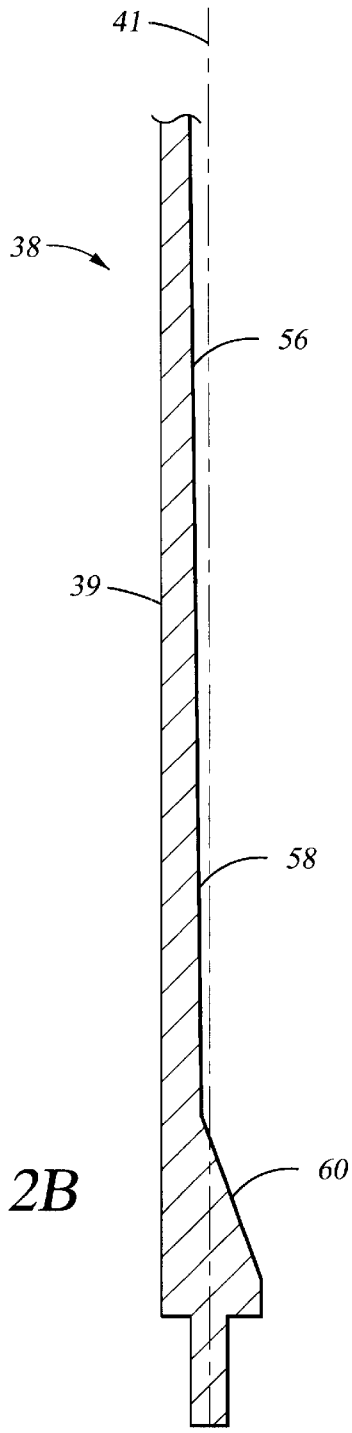

FIGS. 2A and 2B illustrate an exemplary whipstock 38 constructed in accordance with the present invention. The whipstock 38 has an elongated whipstock body 39 having a longitudinal axis as represented by the reference line 41. The whipstock 38 presents a series of mill engagement faces made up of a composite of slanted portions. It should be noted that the values provided for distances and angular slopes are exemplary only and are not intended to be limiting. Generally, the inventive whipstock 38 is thinner along the majority of its length than typical conventional whipstocks. The upper end of the whipstock 38 presents a first sloped surface 50 having a fifteen degree angle from the axis 41. Below that, a second sloped surface 52 is angled at essentially zero degrees from the axis 41. This second surface continues downwardly along the length of the whipstock 38 for approximately two feet. Immediately below the second surface, a third sloped surface 54 is provided having an angle of three degrees from the axis 41.

A maintenance surface 56 is provided below the three degree surface. The maintenance surface engages the mill tool 30 as shown in FIG. 3C and maintains it substantially in an optimal position to allow the mill tool 30 to cut a window of substantially maximum width within the casing 32. The maintenance surface 56 has a length which is approximately equal to the desired length for a window of substantially maximum width. The maintenance surface 56 forms an angle of zero degrees with the axis 41. As a result, a mill engaging the maintenance surface 56 will not be urged outwardly through the casing as it moves downwardly through the wellbore. Below the maintenance surface 56, a fourth sloped surface 58 is provided which is angled at approximately one degree from the axis 41. Finally, a lower sloped portion 60 of the whipstock 38 provides a fifteen degree sloped surface from the axis 41.

Figure 6:
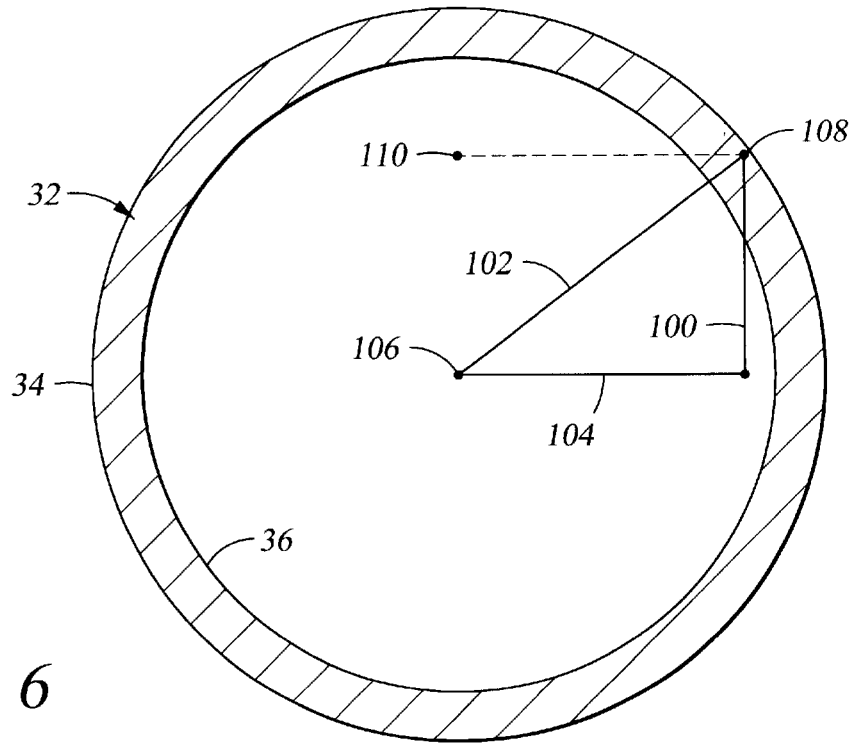
FIG. 6 graphically depicts the relationship between casing radius, mill radius and an optimum mill displacement.

As noted, the invention capitalizes upon the inventor's recognition that a window's width is maximized when the center line of the mill tool is located inside of the inner diameter of the casing, as previously described. An optimal mill displacement (OMD) distance 100 can be determined if the casing radius (CR) 102 and the milling radius (MR) 104 are known. The relationship is also depicted graphically in FIG. 6. The optimal mill displacement distance 100 is the desired amount of movement of the center of the mill tool 30 from the central axis 106 of the casing 32. The casing radius 102 is the distance from the central longitudinal axis 106 of the casing to a point 108 on or within the diameter of the casing 32. In other words, the casing radius 102 may be measured from the inner surface 36 or the outer surface 34 of the casing 32 as well as any point in between the inner and outer surfaces as shown in FIG. 6. The milling radius 104 is the radius presented by the lead mill 68 of the mill tool 30. These distances are related mathematically according to the following equation: $OMD=\sqrt{(CR)^2-(MR)^2}$. Once an optimum mill displacement distance 100 is determined, the mill tool 30 is displaced that distance so that the mill axis 42 is moved to a desired displacement location 110 depicted in FIG. 6.

Referring now to FIGS. 3A–3F, a side cross-sectional view is shown of a portion of a wellbore wherein the steel casing 32 is disposed within a cement liner 62 and disposed through an earth formation 64. The casing 32 contains the whipstock 38 constructed in accordance with the present invention. Also shown, progressively milling a window, is the mill tool 30. The mill tool 30 includes a central shaft 66 with a lead mill 68 and follower mill 70 (visible in FIG. 3C). It should be understood that the design and precise components of the mill 30 may be varied.

The milling diameter (d) of the mill tool 30 is typically established by the diameter of the lead mill 68. The follower mill 70 may have the same approximate milling diameter although other components of the milling tool are smaller in diameter. It is generally desired to have the milling diameter as large as is operationally possible within the casing 32. Therefore, the milling diameter is typically set at or around the drift diameter for the wellbore casing 32.

Figure 3A:
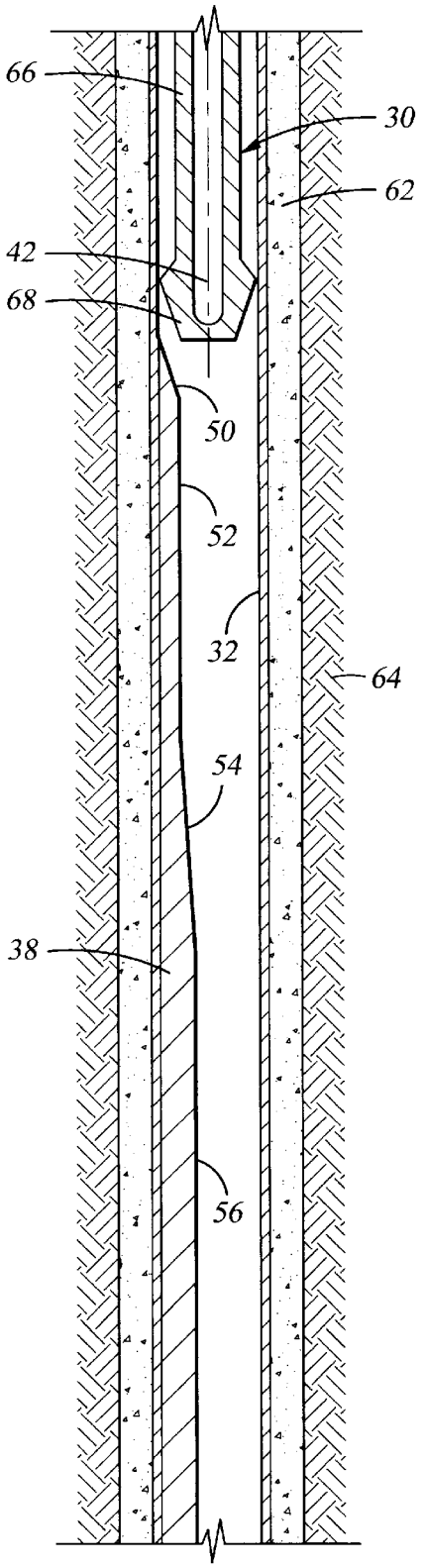
FIGS. 3A–3E are cross-sectional depictions of an exemplary milling operation using the whipstock shown in FIGS. 2A and 2B.
Figure 3B:
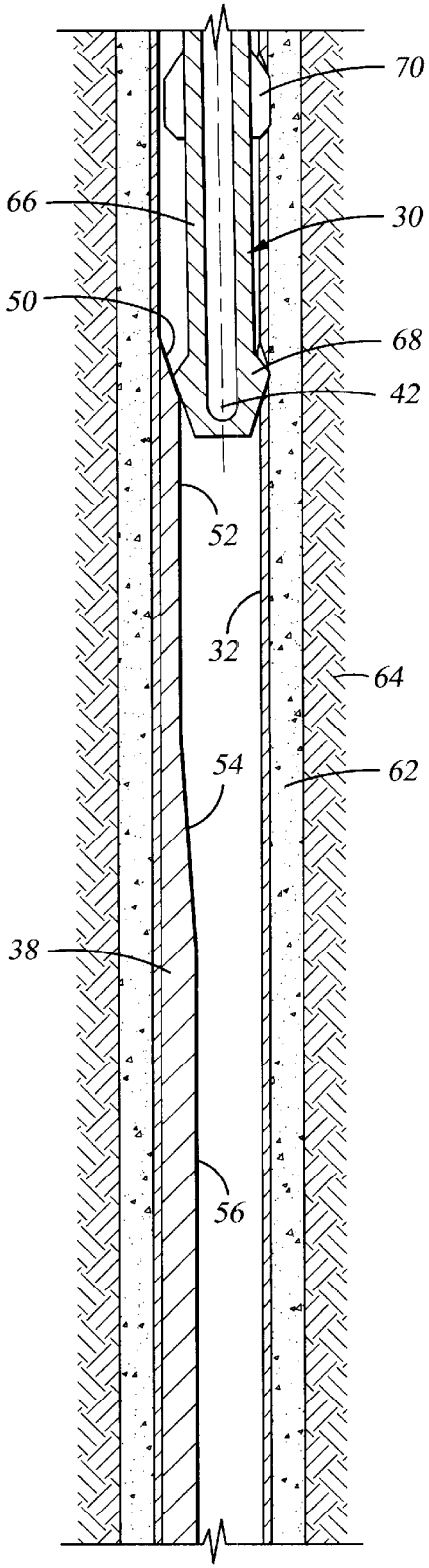
Figure 3C:
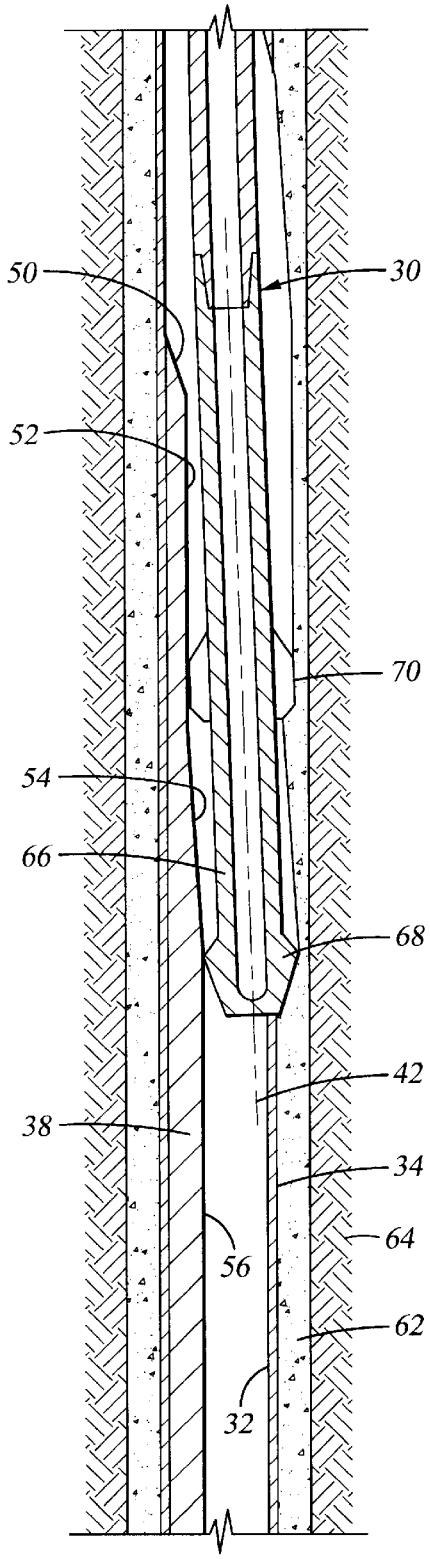

In FIG. 3A, the mill 30 is being lowered through the center of the casing 32. In FIG. 3B, the lead mill 68 engages the first sloped surface 50 and is deviated outwardly so that the casing 32 begins to be milled away.

In FIG. 3C, the mill 30 has moved downwardly to the extent that the lead mill 68 of the mill tool 30 engages the maintenance surface 56 of the whipstock 38. The axis 42 of the mill tool 30 is disposed within the inner diameter of the casing 32, and the diameter of the mill tool 30 is substantially aligned with the outer surface 34 of the casing 32 (see FIG. 4). As the mill tool 30 is moved further downwardly within the borehole, it will continue to travel along the maintenance surface 56 and be maintained in substantially the same relationship of distance between the axes of the mill tool 30 and wellbore. Ultimately, the mill tool 30 will engage the lower sloped surface 60, causing the mill tool 30 to be deviated outwardly through the casing 32, thus completing the window cutting operation.

Figure 3D:
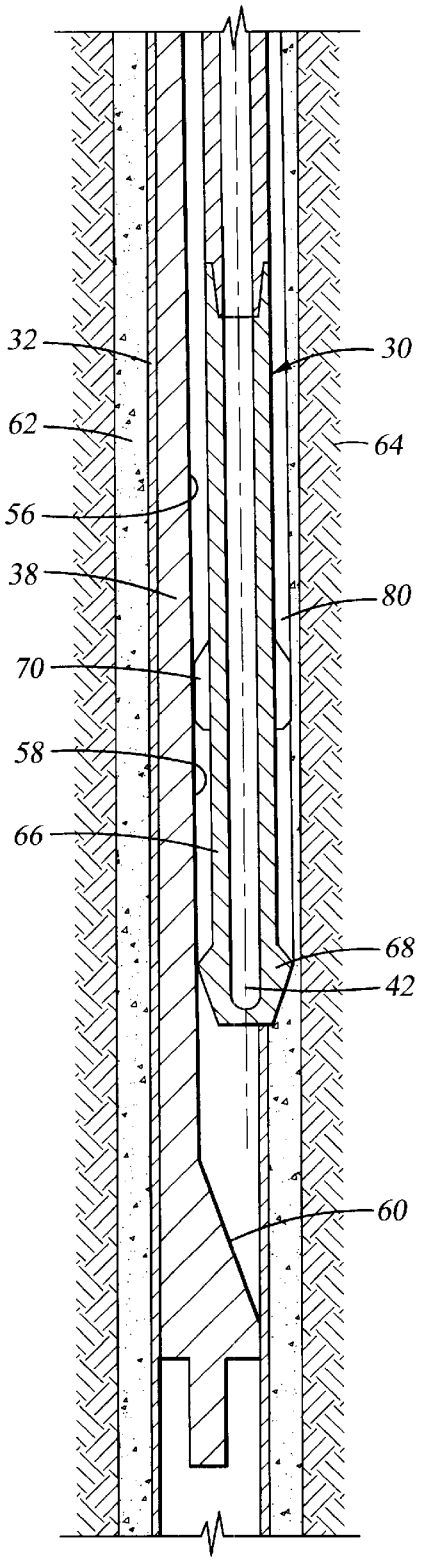
Figure 3E:
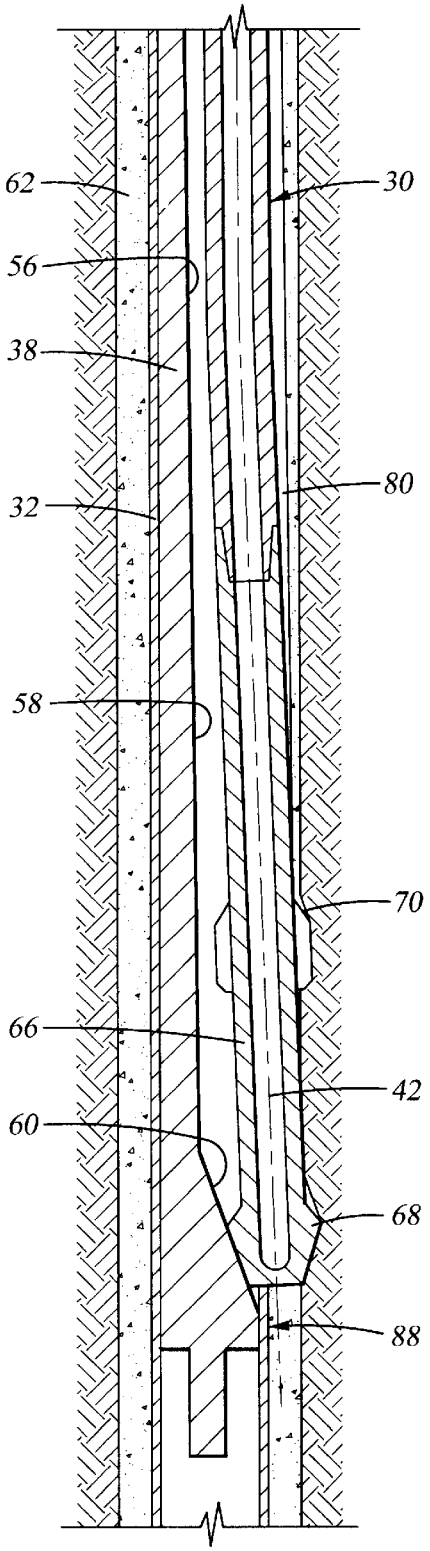

FIGS. 3D and 3E depict the portion of the wellbore in which the lower portion of the whipstock 38 is located and help illustrate the cutting of the lower end 88 of the window 80. The window 12 has been cut as the lead mill 68 engaged and moved along the maintenance surface 56. In FIG. 3D, the lead mill 68 engages and travels along the slightly outwardly-deviated surface 58 on the whipstock 38, thus urging the mill 30 outwardly away from its optimal cutting position and allowing the window 80 to begin narrowing in width.

In FIG. 3E, the lead mill 68 has engaged the lowest sloped surface 60 whereupon the mill tool 30 is being urged radially outwardly beyond the casing 32. At this point, the central axis 42 of the mill 30 crosses the wall of the casing 32 and the width of the window 80 will be smaller still, until the lower end 88 of the window is cut at the approximate location shown in FIG. 3E. Because engagement of the mill 30 with the engagement surfaces 58 and 60 will cause the window 80 to narrow in width, it is preferred that these surfaces be quite small in longitudinal distance as compared to the maintenance surface 56, thereby permitting the window 80 to have a shape substantially like that shown in FIG. 5.

Figure 5:
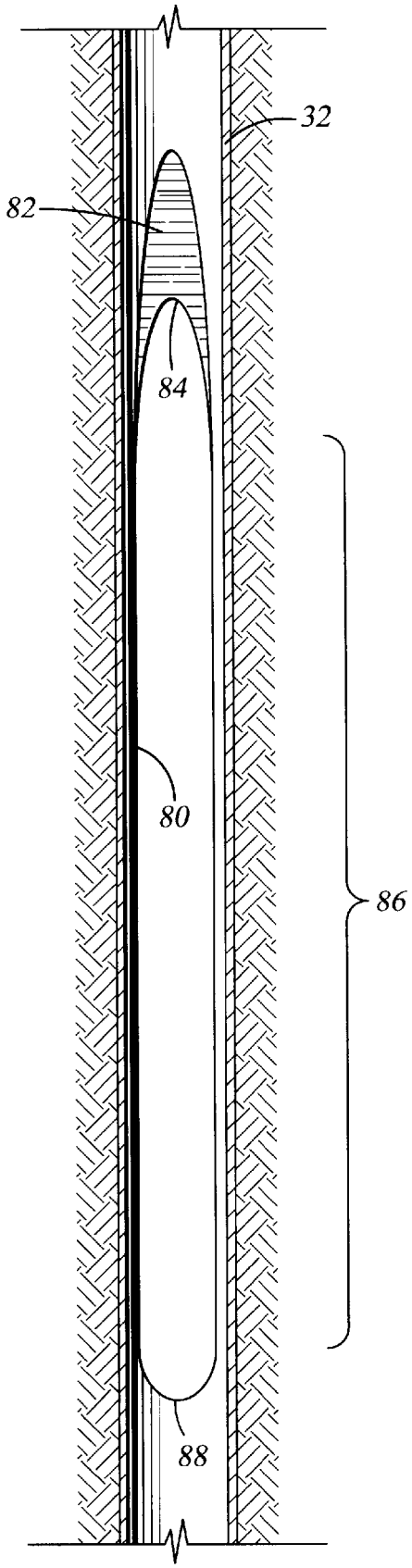
FIG. 5 is a cross-sectional view of a borehole casing depicting an exemplary optimized window which might be cut using the methods and apparatus of the present invention.

As a result of the method of cutting described, a window is drilled having virtually maximum width for a predetermined length. FIG. 5 depicts an exemplary window 80 of this type. The window 80 features a milled upper portion 82. Proximate its top end 84, the window 80 widens outwardly and provides a section of substantially maximum width 86 that extends nearly the entire length of the window 80. The window 80 is optimized in the sense that it provides a substantially maximum width along a significant portion of its length. The window has a larger than normal width in its lower half rather than a narrowed tapering shape. As a result, it is easier to create a deviated borehole through the lower portion of the window.

The top end 84 of the window 80 will be cut as the lead mill 68 engages and moves along the upper ramp 50. The lower end 88 of the window 80 will be formed when the lead mill 68 engages the lower sloped surface 60. It will be understood that the maximum width portion of the window 80 may be made to be essentially any length desired by making the maintenance surface 56 of a corresponding length.

Figure 4:
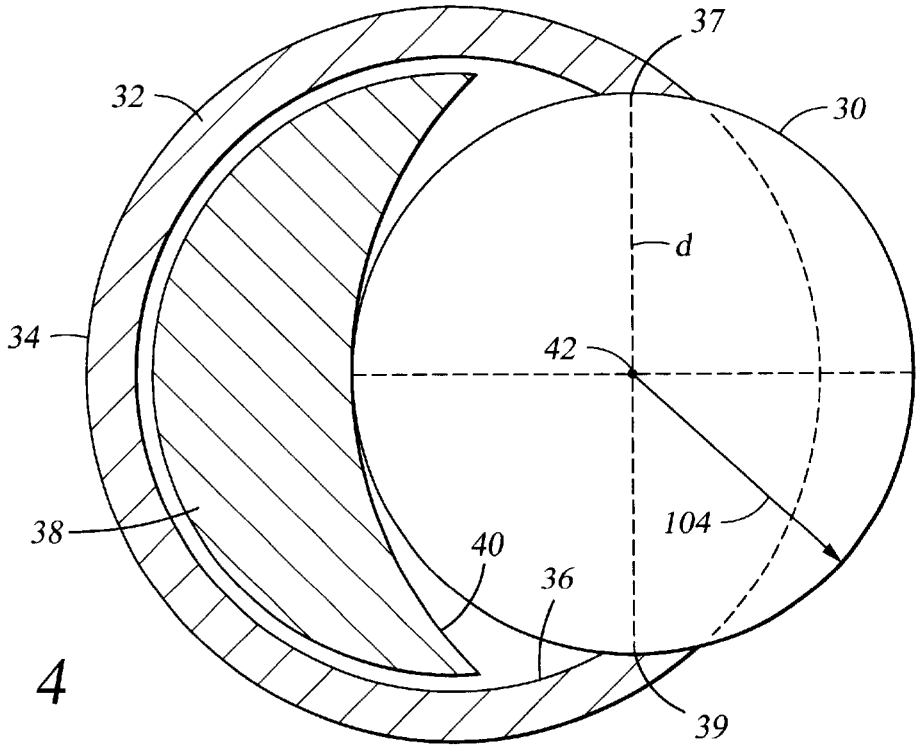
FIG. 4 is a top cross-sectional view of a mill tool, whipstock and casing.

FIG. 4 depicts, through a top cross-sectional view, the approximate desired location for a mill tool 30 with respect to wellbore casing 32 in order to achieve maximum cutting away of the casing wall. Casing 32 represents a steel casing which is cylindrical in shape. The casing wall presents an outer surface 34 and an inner surface 36. Also shown in FIG. 4 is a whipstock 38 having a mill engagement face 40. The mill tool 30 is shown as cutting through the wall of the casing 32. The mill tool 30 has a central axis, shown at 42. As illustrated, the axis 42 of the mill tool 30 is located inside of the inner surface 36 of the casing 32. In addition, the diameter (d) of the mill tool 30 is shown to be intersecting the wall of the casing 32 at two points 37, 39.

Figure 7A:
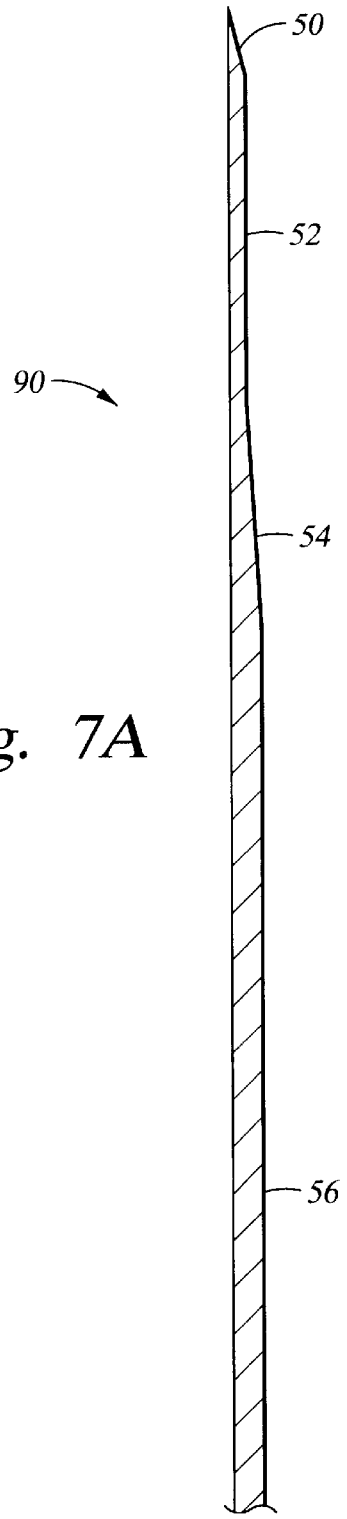
FIGS. 7A and 7B illustrate an alternative design for a whipstock constructed in accordance with the present invention.
Figure 7B:
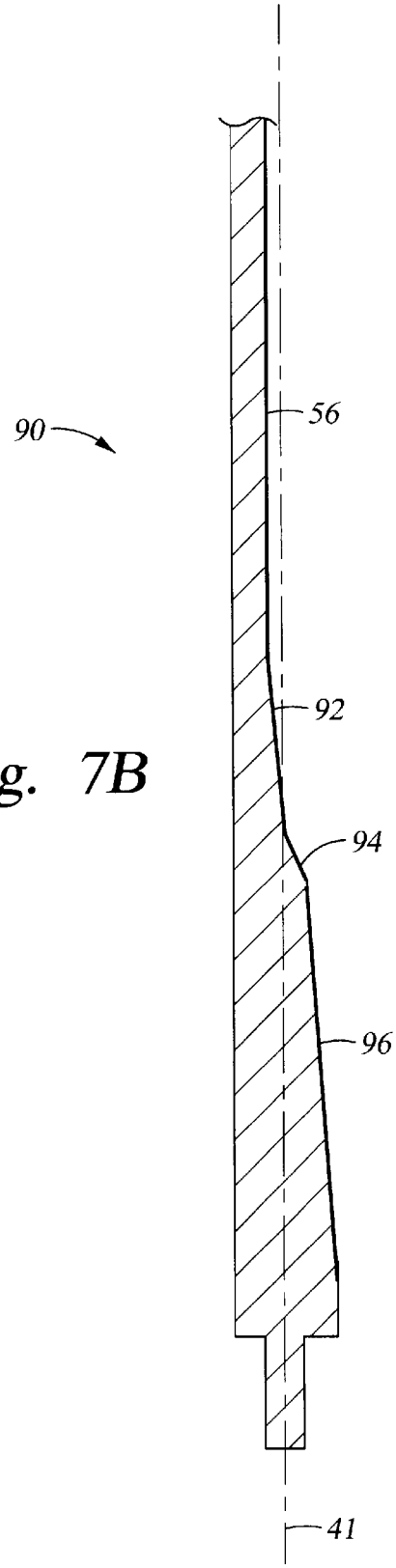

FIG. 7 depicts an alternative whipstock design 90 that might be used in accordance with the present invention. For most of its length, the alternative whipstock 90 is constructed in a manner similar or identical to the initial whipstock 38. Because of the similarities, like reference numerals are use for like components. The upper engagement surfaces of the whipstock 90 are the same as those of the whipstock 38 described previously. Further, an elongated maintenance surface 56 is provided which forms an angle of approximately 0 degrees with the vertical axis 41. Below the maintenance surface 56, are sloped surfaces 92, which forms an angle of approximately 3 degrees with the axis 41, 94, which forms an angle of approximately 15 degrees with the axis 41, and 96, which forms an angle of approximately 3 degrees with the axis 41. The lower surfaces 92, 94 and 96 serve to progressively ramp the mill 30 outward from the maintenance surface 56 until the central axis of the mill is moved radially outside of the casing and the lower end of the window 80 is cut.

Figure 8:
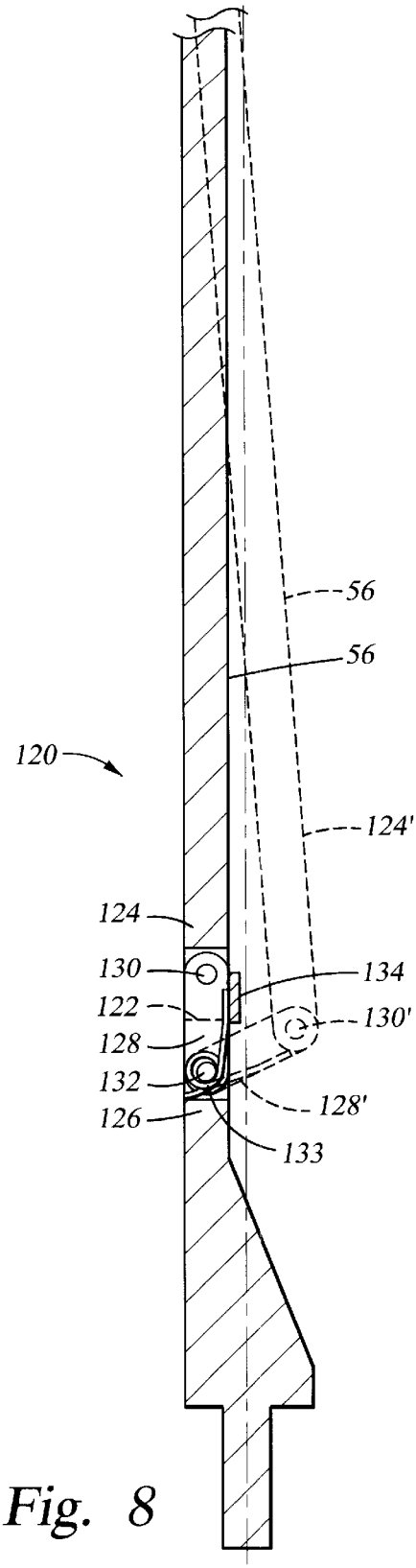
FIG. 8 depicts an exemplary actuatable ramp which can be used to urge the mill tool radially outside of the casing after an optimized window has been cut.

In a further alternative embodiment of the invention, depicted in FIG. 8, an actuated ramp is used to deviate the mill tool radially outward from proximate its optimal cutting position to a location outside of the casing. FIG. 8 shows the lower end of a whipstock 120. The upper portion of the whipstock (not shown) will substantially resemble in construction the whipstock 38 previously described. Maintenance surface 56 is provided which forms an angle of approximately 0 degrees with the central axis of the whipstock, as previously described. The body of the whipstock 120 is divided at 122 so that an upper portion 124 and a lower portion 126 are provided. The upper and lower portions 124, 126 are interconnected by a linkage 128 that provides a pair of pivot points 130, 132. The lower pivot 132 is biased by a torsional spring 133 so that the linkage 128 can be moved outwardly to an angled position, shown as 128', and carry the upper portion 124 of the whipstock 120 outward to the position shown as 124'. A securing member 134 is attached to the whipstock 120 proximate the linkage 128 so that the torsional spring is restrained against moving the upper portion 124 of the whipstock 120 to the position 134'. The securing member 124' may comprise a metal plate or shank that is bolted in place on the whipstock 120. Alternatively, a collar or clamp might be used.

In operation, a mill tool, such as mill 30, will travel along the maintenance surface 56 and, upon encountering the securing member 134, will mill the securing member 134 away, thereby actuating a ramp formed by the upper portion 124 of the whipstock 120 as it is moved with respect to the lower portion 126. The upper portion 124 of the whipstock 120 will be moved to, or toward, the location shown at 124' by the torsional spring when the mill is pulled uphole. As a result, the mill tool will be deviated radially outwardly away from its optimal milling position and allow a rathole to be cut on a subsequent pass.

It will, of course, be realized that various modifications can be made in the design and operation of the present invention without departing from the spirit thereof. For example, an "optimum" width for a selected window is not necessarily required to be a window of maximum width, but a preselected width. One can determine a desired location for the whipstock maintenance surface with respect to the surrounding casing by calculation, using the techniques described herein. This desired maintenance surface location can be varied based upon what the desired window width is to be. Thus, while principal preferred constructions and modes of operation of the invention have been described herein, in what is now considered to represent the best embodiments, it should be under stood that within the scope of the appended claims, the invention may be practiced otherwise than as specifically illustrated and described.

What is claimed is:

1. A method for forming a resultant window having a longitudinal length in a portion of borehole casing having an axis and a wall, the method comprising:

deviating a till tool radially outwardly to an optimum cutting position with respect to the casing for cutting the casing to form the window having a substantially uniform width along the longitudinal length;

contacting the mill tool with a maintenance surface on a whipstock to maintain the mill tool in the optimum cutting position, the maintenance surface being substantially parallel with the casing axis; and cutting the longitudinal length of the window by moving the mill tool along the maintenance surface.

2. The method of claim 1 wherein the operation of deviating the mill tool radially outwardly further comprises guiding the mill tool along a sloped surface.

3. The method of claim 1 further comprising the operation of further deviating the mill tool outside of the casing to complete the cutting of the window.

4. The method of claim 3 wherein the operation of deviating the mill tool outside of the casing to complete the cutting of the window further comprises engaging a ramp that reciprocates with respect to the whipstock.

5. The method of claim 4 wherein engaging the ramp releases a securing member.

6. The method of claim 4 wherein engaging the ramp releases a torsional spring.

7. The method of claim 4 wherein the ramp comprises a linkage which interconnects a pair of whipstock portions that can move with respect to one another.

8. The method of claim 1 wherein the optimum cutting position comprises a position wherein an axis of the mill tool is located internally of the casing.

9. The method of claim 8 wherein the optimum cutting position further comprises a maximum width cutting position wherein the wall of the casing is intersected at two points by the milling diameter of the mill tool.

10. The method of claim 1 wherein the maintenance surface has a length substantially equal to the longitudinal length of the window.

11. The method of claim 1 wherein the maintenance surface does not cause the mill tool to be deviated radially outwardly.

12. The method of claim 1 wherein the optimum cutting position defines a radial location of a centerline of the mill that remains substantially unchanged with respect to the axis of the casing.

13. The method of claim 1 wherein the maintenance surface is formed at a nominal angle of zero degrees with respect to an axis of the whipstock, the nominal angle including manufacturing tolerances.

14. The method of claim 1 wherein the resultant window has a substantially maximum width at a position along the longitudinal length where a rathole is drilled therethrough.

15. A whipstock for guiding a mill tool to cut a resultant window having a length in a casing in a borehole, comprising:

an elongated whipstock body having a longitudinal axis;

said body having a maintenance surface that forms a substantially zero degree angle with the body axis for engaging the mill tool and retaining the mill tool in an optimum cutting position to mill the window having a substantially uniform width along the length.

16. The whipstock of claim 15 further comprising a sloped surface for engaging the mill tool and deviating the mill tool to the optimum cutting position.

17. The whipstock of claim 15 further comprising a ramped surface for deviating the mill tool from the optimum cutting position to a position radially outside of the surrounding casing.

18. The whipstock of claim 17 wherein the ramped surface comprises a pair of whipstock portions that can move with respect to one another.

19. The whipstock of claim 18 wherein the pair of whipstock portions is interconnected by a linkage.

20. The whipstock of claim 17 wherein the ramped surface is capable of reciprocating with respect to the whipstock body.

21. The whipstock of claim 20 wherein a securing member prevents the ramped surface from reciprocating with respect to the whipstock body.

22. The whipstock of claim 20 wherein a torsional spring forces the ramped surface to reciprocate with respect to the whipstock body.

23. The whipstock of claim 15 wherein the maintenance surface has a length substantially equal to the window length.

24. The whipstock of claim 15 wherein the maintenance surface does not cause the mill tool to be deviated radially outwardly.

25. The whipstock of claim 15 wherein the optimum cutting position defines a radial location of a centerline of the mill that remains substantially unchanged with respect to an axis of the casing.

26. A method for cutting a resultant window having a top end, a lower end, and a length therebetween in a casing having an axis and an outer surface, comprising:

engaging the casing with a mill having a centerline to form an arcuate cutting surface therebetween for cutting the window a uniform width throughout the length;

substantially maintaining the same arcuate cutting surface as the mill is moved longitudinally along the length with respect to the axis of the casing; and cutting the length of the resultant window.

27. The method of claim 26 wherein the arcuate cutting surface defines a chord substantially equal to the uniform width of the length.

28. The method of claim 27 wherein the chord comprises a distance between a first and a second point on the outer surface of the casing thereby defining the uniform width of the length.

29. The method of claim 26 further including displacing the centerline of the mill with respect to the axis of the casing.

30. The method of claim 29 wherein the centerline remains internal of the casing as the mill is moved along the length.

31. The method of claim 29 wherein the operation of displacing the centerline of the mill comprises moving the mill along a sloped surface.

32. The method of claim 26 wherein the operation of substantially maintaining the same arcuate cutting surface comprises moving the mill along a surface that parallels the axis of the casing.

33. The method of claim 32 wherein the surface has a length substantially equal to the length of the resultant window.

34. The method of claim 26 wherein the resultant window comprises substantially parallel longitudinal sides along the length.

35. The method of claim 26 wherein the uniform width is less than a maximum width that the mill is capable of cutting.

36. A method for cutting a resultant window in a casing having an axis, the window having a top end, a lower end, and a length having parallel sides, comprising:

engaging a mill on a first guide surface to move cutting surfaces on the mill against the casing;

continuing the movement of the mill to cut the top end until the cutting surfaces are in position to cut the parallel sides of the length; and engaging the mill on a second guide surface to guide the mill axially through the casing to cut the parallel sides along the length.

37. The method of claim 36 wherein the second guide surface retains a centerline of the mill in substantially the same radial position with respect to the axis of the casing.

38. The method of claim 36 wherein the second guide surface has a length substantially equal to the length of the window.

39. The method of claim 36 wherein the parallel sides define a width sufficient for drilling a rathole therethrough.

40. The method of claim 36 wherein the parallel sides define a maximum width that the mill is capable of cutting.

41. A method for forming a resultant window having a top end, a lower end, and a length in a casing having an axis comprising:

disposing a mill tool internally of the casing in a radially optimal cutting position with respect to the casing axis;

cuttingly engaging the mill tool with the casing; and maintaining the mill tool in substantially the same radially optimal cutting position while moving the mill tool longitudinally to form the length of the resultant window.

42. A whipstock for forming a resultant window in a casing, the window having a substantially rectangular lower portion, comprising:

means for deviating a mill tool centerline to a radially optimal cutting position with respect to the casing;

means for maintaining the mill tool centerline in substantially the same radially optimal cutting position while the mill tool is moved longitudinally; and means for deviating the mill tool centerline through the casing to form the substantially rectangular lower portion.

* * * * *